US005680973A

United States Patent [19]

Vulpitta et al.

[11] Patent Number: 5,680,973

[45] Date of Patent: Oct. 28, 1997

[54] PORTABLE CHILDREN'S ACTIVITY STATION

[75] Inventors: Brian A. Vulpitta, Avon Lake; Diane L. Walsh, Garfield Heights; John R. Nottingham, Hunting Valley; Jeffrey Plantz, Seven Hills; Patrick J. Coyne, Shaker Heights, all of Ohio

[73] Assignee: Manco, Inc., Avon, Ohio

[21] Appl. No.: 515,952

[22] Filed: Aug. 16, 1995

[51] Int. Cl.[6] ..... A45F 3/04; A45F 5/12

[52] U.S. Cl. ..... 224/153; 224/629; 108/43

[58] Field of Search ..... 224/153, 616, 224/275, 628, 629, 630; 190/110, 127, 3, 4, 5, 6, 7, 11, 109, 111, 901, 902, 903; 493/959; D3/206, 208, 224, 227, 253, 256, 900; 108/43

[56] References Cited

U.S. PATENT DOCUMENTS

| | | | |
|---|---|---|---|
| D. 200,881 | 4/1965 | Anderson | D3/900 |
| D. 322,891 | 1/1992 | Samuelson et al. | D3/206 |
| D. 358,935 | 6/1995 | Chang et al. | D3/900 |
| 2,554,215 | 5/1951 | Schell et al. | 190/901 |
| 3,110,376 | 11/1963 | Naab et al. | 190/903 |
| 4,335,812 | 6/1982 | Koves | 224/616 |
| 4,463,789 | 8/1984 | Leisserson | 190/110 |
| 4,538,861 | 9/1985 | Hughes, Jr. | 190/11 |
| 4,700,634 | 10/1987 | Mills et al. | 108/43 |
| 4,796,735 | 1/1989 | Horiuchi | 190/109 |
| 4,883,207 | 11/1989 | McArthur | 224/153 |
| 5,028,048 | 7/1991 | Watson et al. | 190/110 |
| 5,115,893 | 5/1992 | Terkildsen | 190/11 |
| 5,217,119 | 6/1993 | Hollingsworth | 190/127 |
| 5,295,742 | 3/1994 | Knutson | 108/43 |
| 5,447,215 | 9/1995 | Volkmar et al. | 190/11 |
| 5,460,102 | 10/1995 | Pasmanick | 108/43 |

OTHER PUBLICATIONS

Catalog, Toys To Grow On, Holiday Preview 1994, Roll & Go Suitcase, p. 32.

Parents Magazine, Jul. 1995, Lap Desk, p. 135.

Advertising Circular, Dial Industries Inc., Stor 'N Carry Carrying case.

Advertising Circular, Austin–Abbott, Inc., Busy Board, A Take Along Activity Center.

Advertising Circular, Austin–Abbott, Inc., Busy Box, Storage Bin.

Catalog, Hand In Hand, Summer 1994, Travel Portfolio, p. 8.

Catalog, One Step Ahead, Kid's Car Tray, p. 30.

Advertising Circular, Eldon–Rubbermaid Office Products, 1994 Lap Topper.

*Primary Examiner*—Henry J. Recla
*Assistant Examiner*—Charles R. Eloshway
*Attorney, Agent, or Firm*—Vickers, Daniels & Young

[57] ABSTRACT

A portable lap desk and activity station is provided for use by a small child, middle aged children and even adults. The lap desk includes a front side wall, a rear side wall and edge walls extending therebetween which define a main compartment. The front side wall is substantially planar and rigid for use as a work or writing surface by the child. The rear side wall is flexible and padded for comfortably resting on the lap of a child.

32 Claims, 8 Drawing Sheets

PORTABLE CHILDREN'S ACTIVITY STATION

BACKGROUND OF THE INVENTION

The present invention pertains to the art of hand carried luggage and more particularly to a carrying bag which can be used as a children's activity station and desk surface as well as a bag for carrying a child's activity materials.

Parents generally provide their children with a variety of containers for carrying toys and materials and school work. Thus, book bags and lunch boxes are commonly provided to small children. Some of these bags are meant to be carried by means of a hand grip while other bags are provided with shoulder straps for carrying on one shoulder or both shoulders like a rucksack. These bags are often acceptable in their function of carrying toys and the like but perform no other functions.

Families sometimes take trips in automobiles, planes or other vehicles. Children are often encouraged to entertain themselves with their toys or activity materials on such trips not only while they are going but after they arrive at a destination. For example, at the grandparents, daycare, playground, park etc. a child will often be asked to entertain himself or herself. It is thus necessary for a child to bring along a book bag or the like from which he will remove his activity materials. In such a situation, the child is not generally provided with a good surface to perform activities and can therefore become frustrated quickly.

At other times, the surface provided is a clipboard, book or the like resting on the child's lap. Such surfaces are often too low with respect to a child's torso and are often uncomfortable in that a hard rigid surface is placed against a child's thighs and upper leg areas. Some lap desks are cushioned but do not provide anything for storage of the activity materials. Further, organization of activity materials or the like is an important part of starting or completing a project. Having different colored pens, pencils, crayons, etc. within arm's reach facilitates and eases the advancement to completion of a project. Such organization is especially difficult in a vehicle such as an automobile, airplane or train where space is at a premium and movement is limited. Unless activity materials are properly organized, they will likely fall on the floor, under a seat, between seat cushions or under an adjacent person. As such, these materials become lost quickly, frustrating a child or other individual working on a project.

Small items are easily misplaced or left behind in a car, airplane, hotel room unless the item, once used, is immediately put back into the place from which it was retrieved. However, unless replacing the item is made easy with a minimum of effort, it is more likely that the item will be set aside on an adjacent chair, seat or other location. It then becomes difficult to find when it is to be used again or picked up to be transported. This is especially true if the project that is underway must be stopped or interrupted, as is often the case when traveling.

Additionally, there are many households and classrooms throughout the world that have space and money constraints that do not allow children to have a personalized desk of their own.

SUMMARY OF THE INVENTION

The present invention contemplates a new and improved child's activity station which performs the function of a material holder, work surface or organizer and the function of an activity material carry bag at the same time.

In accordance with the present invention, there is provided a child's activity station and craft material carrying case having a handle on its top side a hard surface on its front side, a generally box shaped main compartment and a hinge allowing the front side to be opened, rotating about the top side.

Further in accordance with the invention, the carrying case top side, bottom side, left side and right side are all flexible and generally about three inches from front to back thereby providing a reasonable volume for holding craft materials and a good working height on the lap for children's activities.

Still further in accordance with the invention, the rear side of the carrying case is padded, providing both comfort and stability for the user.

Yet further in accordance with the invention, the side of the carrying case is provided with bins adapted to hold marking pens, crayons, building blocks or interlocking building blocks and the like when the bag is used as a craft station.

Yet further in accordance with the invention, side pockets are provided on the right and left side of the carrying case opening toward the front surface whereby activity materials may be accessed when the front surface is facing upwardly and the compartment is closed.

Yet further in accordance with the invention, the hard writing surface of the bag is provided with a clip near the top side whereby activity materials may be securely held in place even in a moving vehicle.

Still further in accordance with the invention the front side of the bag is provided with closely overlapping flexible corner gussets in some of the corners for further holding down craft work.

Yet further in accordance with the invention, the carry bag is provided with internal compartments adapted to contain activity materials and tools for children.

Still yet further in accordance with the invention, the carry bag is provided with a removable compartment bag, normally stowed in the main compartment, which, when removed, allows access to additional activity materials without accessing the main compartment.

It is the primary object of the present invention to provide a carrying case which also works as a child's activity work station.

It is another object of the present invention to provide a carrying case which can be placed upon the lap of a child with the handle away from the child and open like a school desk allowing easy access to the interior of the case by the child.

It is still another object of the present invention to provide an activity material carrying case having a comfortable rear panel and a hard front panel providing a good work surface and stable support surface for activity projects for children.

It is still another object of the present invention to provide a carrying case which is easily carried by children but also provides a convenient work station for children's activities.

It is still another object of the present invention to provide a children's activity carrying case having a front surface which securely holds an activity project even in a moving vehicle and allows the surface to be tipped up for easy access to additional tools and materials.

It is a further object of the present invention to provide a combined activity work station and carrying case which is light in weight, easily carried and comfortable to use.

It is yet another object of the present invention to provide a combined activity materials carrying case and work station having numerous compartments which are adapted for both organization in carrying and organization of the activities by children.

Still further, it is an object of the present invention to provide a light weight travel desk for adults which is adapted for organization of work activities for use in an automobile, airplane or train.

These and other objects of the invention will become apparent to those skilled in the art upon reading and understanding of the detailed description in the following section.

BRIEF DESCRIPTION OF THE DRAWINGS

The invention may take physical form in certain parts and arrangement of parts, the preferred embodiment of which will be described in detail and illustrated in the accompanying drawings which form a part hereof and wherein.

PREFERRED EMBODIMENTS

Figure 1:
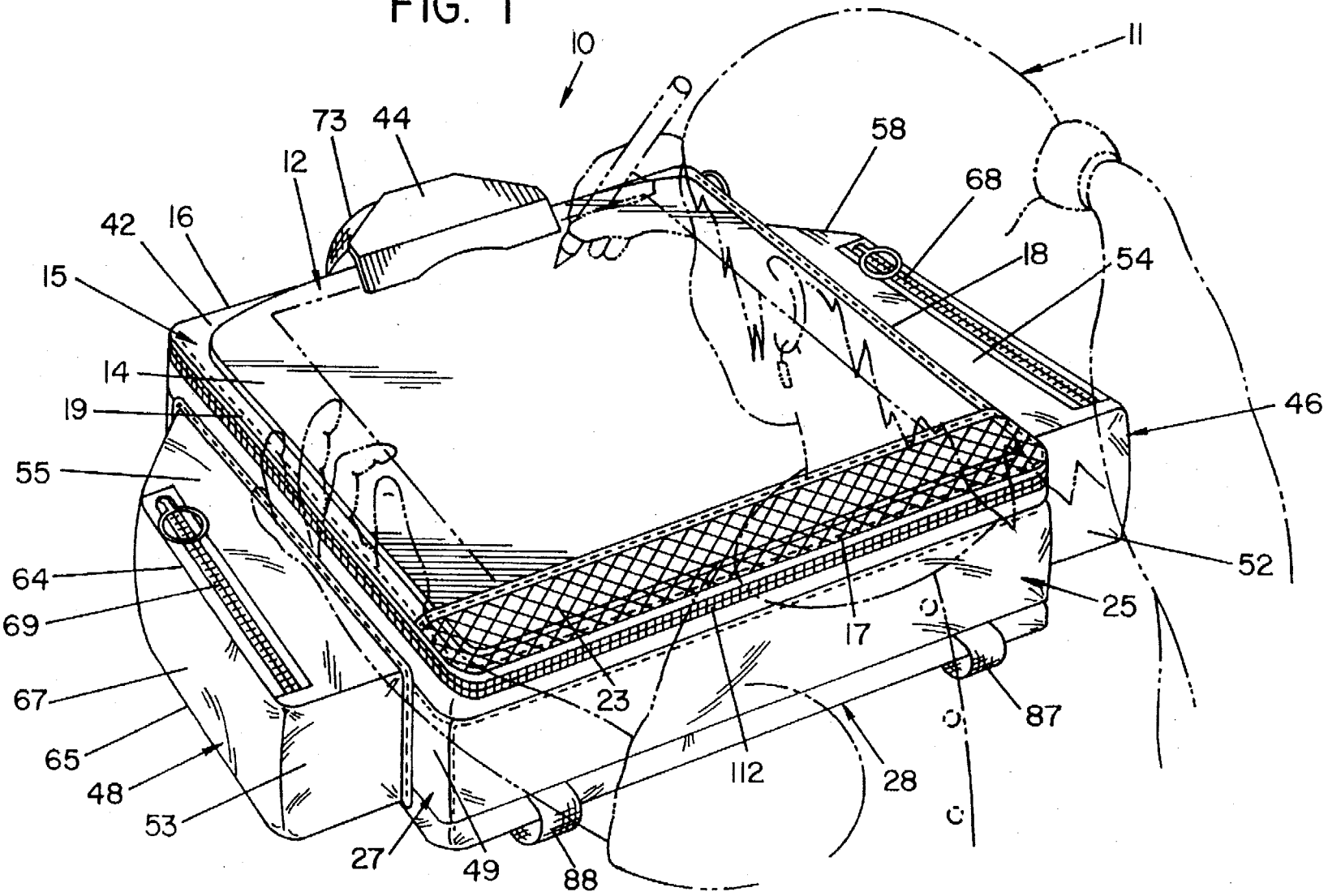
FIG. 1 is a pictorial view illustrating the use of a child's activity station.

Referring now to the drawings, wherein the showings are for the purposes of illustrating the preferred embodiments of the invention only and not for the purposes of limiting same, FIG. 1 shows a child's activity station 10 being used by a child 11, drawn in phantom. Activity station 10 is resting on the lap of child 11 wherein a rigid panel 12 is exposed and upwardly facing. A writing or work surface 14 is provided on panel 12 facing upwardly towards child 11. Panel 12 is retained on a front side wall 15 defined by a top edge 16, a bottom edge 17, a right side edge 18 and a left side edge 19. Rigid panel 12 is retained upon front side wall 15 by a front mesh pocket 23 which is stitched onto front side wall 15 at bottom edge 17 and along a portion of right side edge 18 and left side edge 19 adjacent to bottom edge 17. Preferably front mesh pocket 23 is manufactured from a polyvinyl chloride (PVC) mesh which is rugged and durable, and is less susceptible to stretching with constant use, thus insuring writing panel 12 does not loosen within mesh pocket 23 after repeated uses or repeated removal.

A top wall 24 depends from top edge 16, a bottom wall 25 depends from bottom edge 17, a right side wall 26 depends from right side edge 18 and a left side wall 27 depends from left side edge 19. Each of top wall 24, bottom wall 25, right side wall 26 and left side wall 27 terminate in a rear side wall 28 which is opposite and relatively parallel to front side wall 15. Rigid panel 12 is further attached to front side wall 15 by the use of two sets of the mutually interengaging hook and loop fasteners 32, 33, commonly known as VELCRO. As is well known, hook and loop fasteners include one portion or strip comprised primarily of the loops 34 and one portion or strip comprised primarily of the hooks 35. As shown, loops 34 are attached to a front side face 42 of front side wall 15 while hooks 35 are attached to a back surface 43 of panel 12. In this manner, if rigid panel 12 is removed from activity station 10, hooks 35 would enable panel 12 to be fixedly attached to another fabric upon which it is placed for added stability during use. Rigid panel 12 also includes a clip 44, preferably made of plastic material and attached to writing surface 14. Such clips are spring actuated by spring 45 to hold down papers or craft material on writing surface 14 and are well known in the prior art.

A right side storage bin 46 is attached to a right side outer surface 47 of right side wall 26 and an identical left side storage bin 48 is attached to a left side outer surface 49 of left side wall 27. Each of storage bin 46 and storage bin 48 include a bottom panel 52 and 53, respectively, adjacent and generally parallel to bottom wall 25. Storage bins 46, 48 also include a top panel 54, 55, respectively, and opposite parallel back panels 56, 57, respectively. Each of top panels 54, 55 are adjacent and parallel to front side wall 15 while back panels 56, 57 are adjacent and parallel to rear side wall 28. Panels 54, 56 of storage bin 46 are quadrilateral in shape and connected along the outside edges 58, 59, respectively to outside panel 62 which extends between, and is stitched at, bottom panel 52 and right side outer surface 47 adjacent top wall 24. Each of panels 55, 57 are likewise quadrilateral in shape and connected at the outside edges 64, 65, respectively to outside panel 67 which is connected and is stitched at one end to bottom panel 53 and at an opposite end to left side outer surface 49 adjacent top wall 24. Each of storage bins 46, 48 include the access zippers 68, 69, respectively. Zippers 68, 69 are located on top panels 54, 55, respectively, parallel and adjacent to outside edges 58, 64.

Storage bins 46, 48 are relatively deep between top panels 54, 55 and back panels 56, 57, respectively. In the preferred embodiment, bins 46, 48 are two and three quarter inches deep and further, two and three quarter inches wide between right side outer face 47 and outside panel 62 and likewise between left side outer surface 49 and outside panel 67. Thus, the activity materials for many different crafts may be stored within bins 46, 48 and accessed at any time by a child without disturbing the work on writing surface 14. This is especially useful in the closed or cramped quarters of an automobile or airplane where many different colored pens or pencils or crayons may be used on any one project. By placing zippers 68, 69 on top panels 54, 55 storage bins 46, 48 may be accessed while work or writing surface 14 is being used, without otherwise moving activity station 10.

Top wall 24 includes a carrying handle 73 preferably made from one inch wide canvas webbing. Carrying handle 73 is sewn onto the top wall face 74 of top wall 24 at the box-stitched patch portions 75, 76 adjacent right side wall 26 and left side wall 27, respectively. Carrying handle 73 provides a convenient means for a child to transport activity station 10.

The shoulder straps 81, 82 are provided adjacent rear side wall 28 and provided as an alternative means to carrying handle 73 for transporting activity station 10 by a small child. Each of shoulder straps 81, 82 are comprised of two distinct web portions, the large web portions 83, 84 extend from, and are stitched at, top wall 24 at two points generally centrally located between right side wall 26 and left side wall 27. Large web portions 83, 84 are preferably one and one-half inch wide cotton canvas webbing. At the end of large web portions 83, 84 opposite the end stitched into top wall 24 are the buckles 85, 86, preferably the plastic ladder lock type. The small web portions 87, 88 extend from, and are stitched at, bottom wall 25 at points generally adjacent to right side wall 26 and left side wall 27, respectively. Small web portion 87 intersects large web portion 83 at buckle 85, while small web portion 88 intersects large web portion 84 at buckle 86. The length of shoulder straps 81, 82 may then be adjusted as desired. Each of shoulder straps 81, 82 include a snap 93, 94 comprised of a male snap portion 95, 96 rivetted to large web portions 83, 84, respectively, adjacent top wall 24. A female snap portion 97, 98 is rivetted to small web portions 87, 88, respectively, and located at an end 99, 100 opposite the end attached to bottom wall 25. When snap portions 95, 97 and 96, 98 are interconnected, web portions 87, 88 are prevented from dangling to keep a child from tripping over the ends 99, 100.

At the rear exterior side face 102 of rear side wall 28 is located a slide zipper 103 adjacent and parallel to left side wall 27. Slide zipper 103 can be used to access side pouch 104 located within rear side wall 28 on the rear interior face 105 opposite rear exterior side face 102. This pouch can be used to store additional paper or other large relatively flat items.

Figure 2:
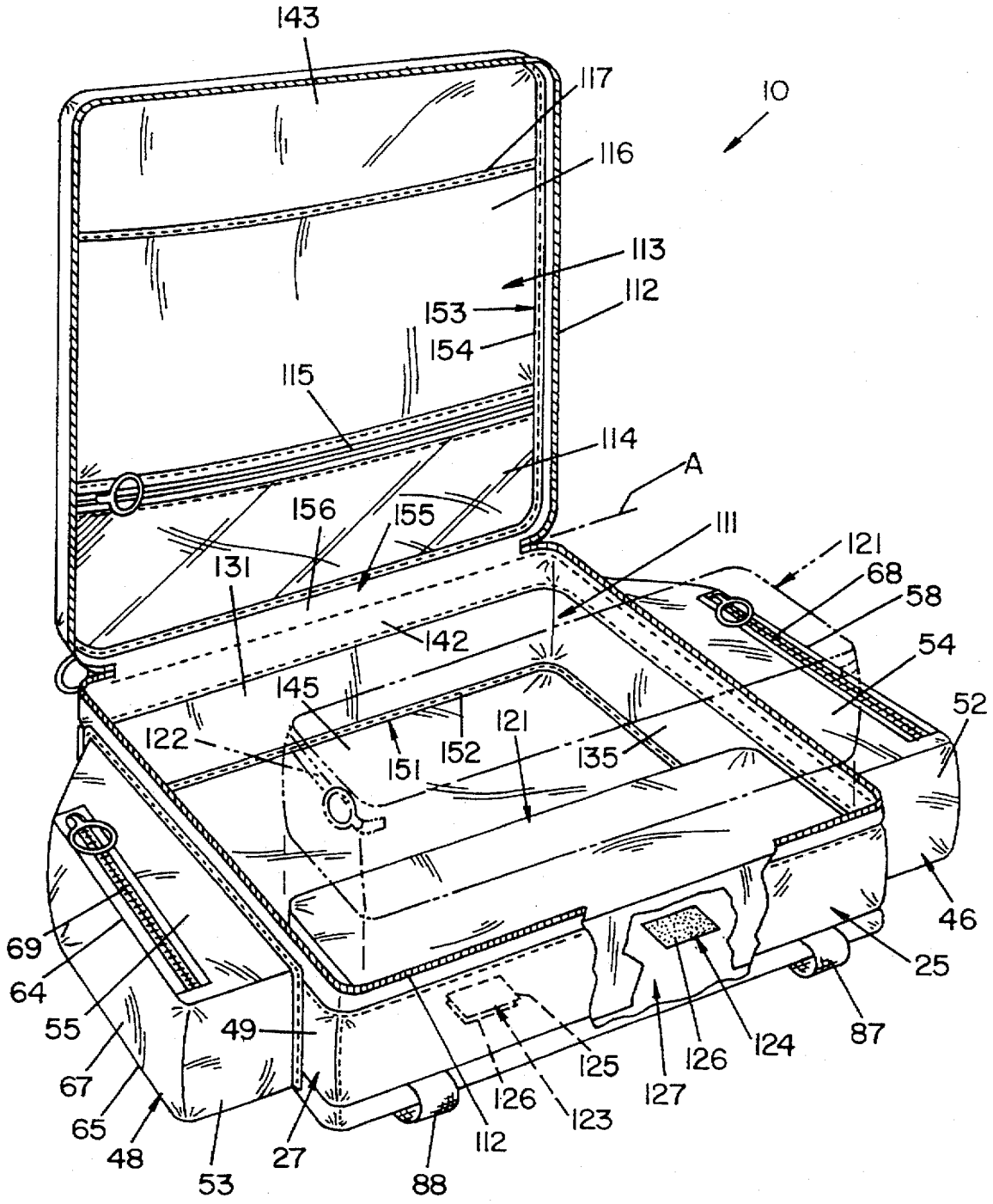
FIG. 2 is an isometric view of the child's activity station showing the interior thereof.
Figure 3:
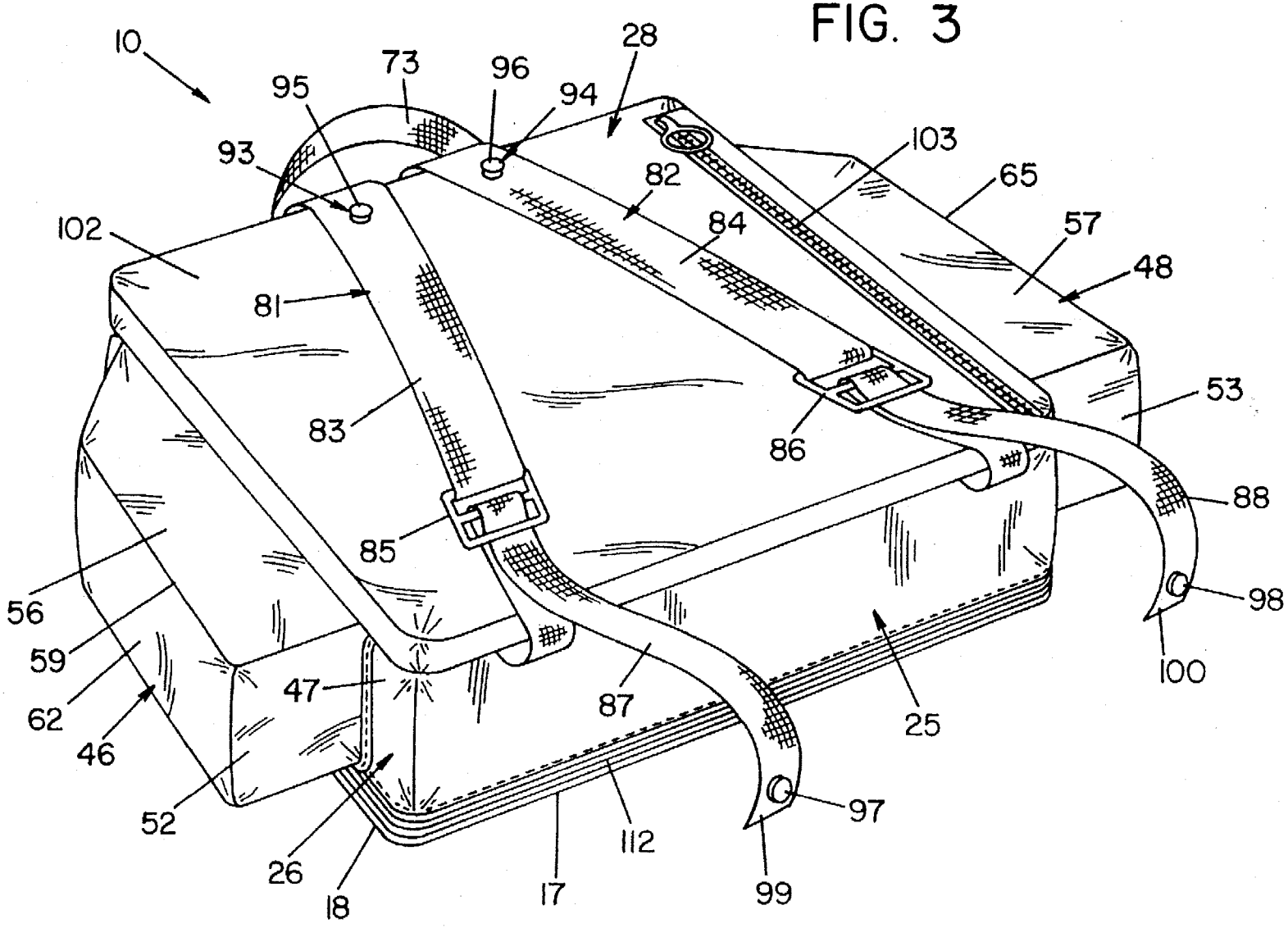
FIG. 3 is an isometric view showing a convenient means of carrying the child's activity station.
Figure 4:
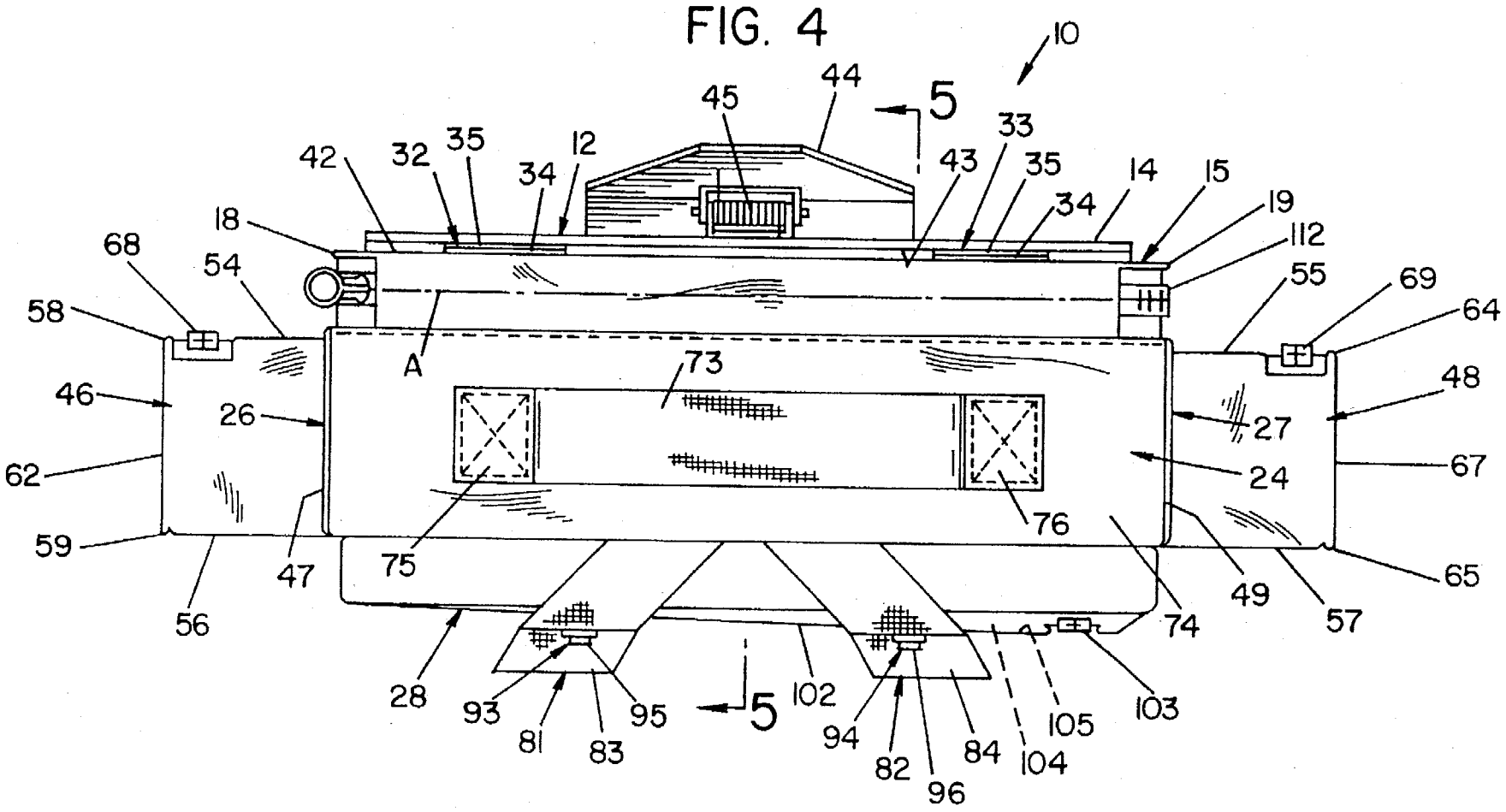
FIG. 4 is an elevation view showing an edge of the child's activity station having a carrying handle attached thereto.

Referring now to FIG. 2, a main interior compartment 111 of activity station 10 is shown. Main compartment 111 is accessed by a main compartment zipper 112 located on each of bottom wall 25, right side wall 26 and left side wall 27. Main compartment zipper 112 is parallel and adjacent to front side wall 15. Upon opening zipper 112, an interior side 113 of front side wall 15 is exposed, as is main compartment 111. Located on interior side 113 is a lateral pouch 114 accessed by a zipper 115 and a slide pouch 116 having an open end 117 for placing papers, coloring books and the like.

Figure 5:
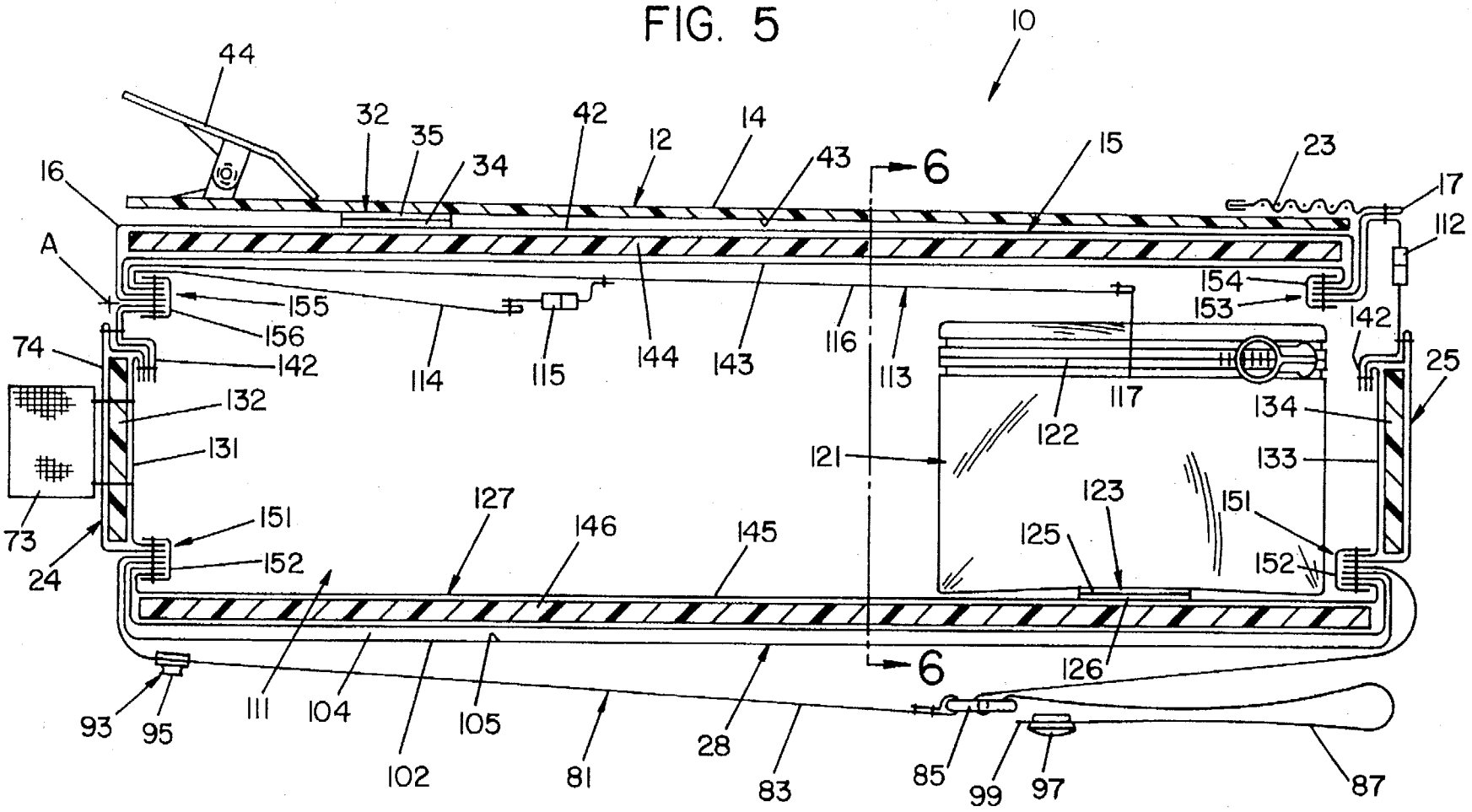
FIG. 5 is a cross-sectional view taken along line 5—5 of FIG. 4.

Located within main interior compartment 111 is a storage bag 121 having a zipper 122. Storage bag 121 is removably attached within main compartment 111 by VELCRO hook and loop fasteners 123, 124. As such, storage bag 121 may be removed from main compartment 111 prior to activity station 10 being used as a writing or work surface in order that additional craft materials may be accessed without disturbing the work in progress. Preferably the hook portion 125 of hook and loop fastener 123, 124 is located on the bottom of storage bag 121, as shown in FIG. 5, so that when removed, storage bag 121 may be releasably retained on adjacent fabric material such as a car or airplane seat. Thus, the loop portion 126 will be located within and at the bottom 127 of main compartment 111.

Figure 6:
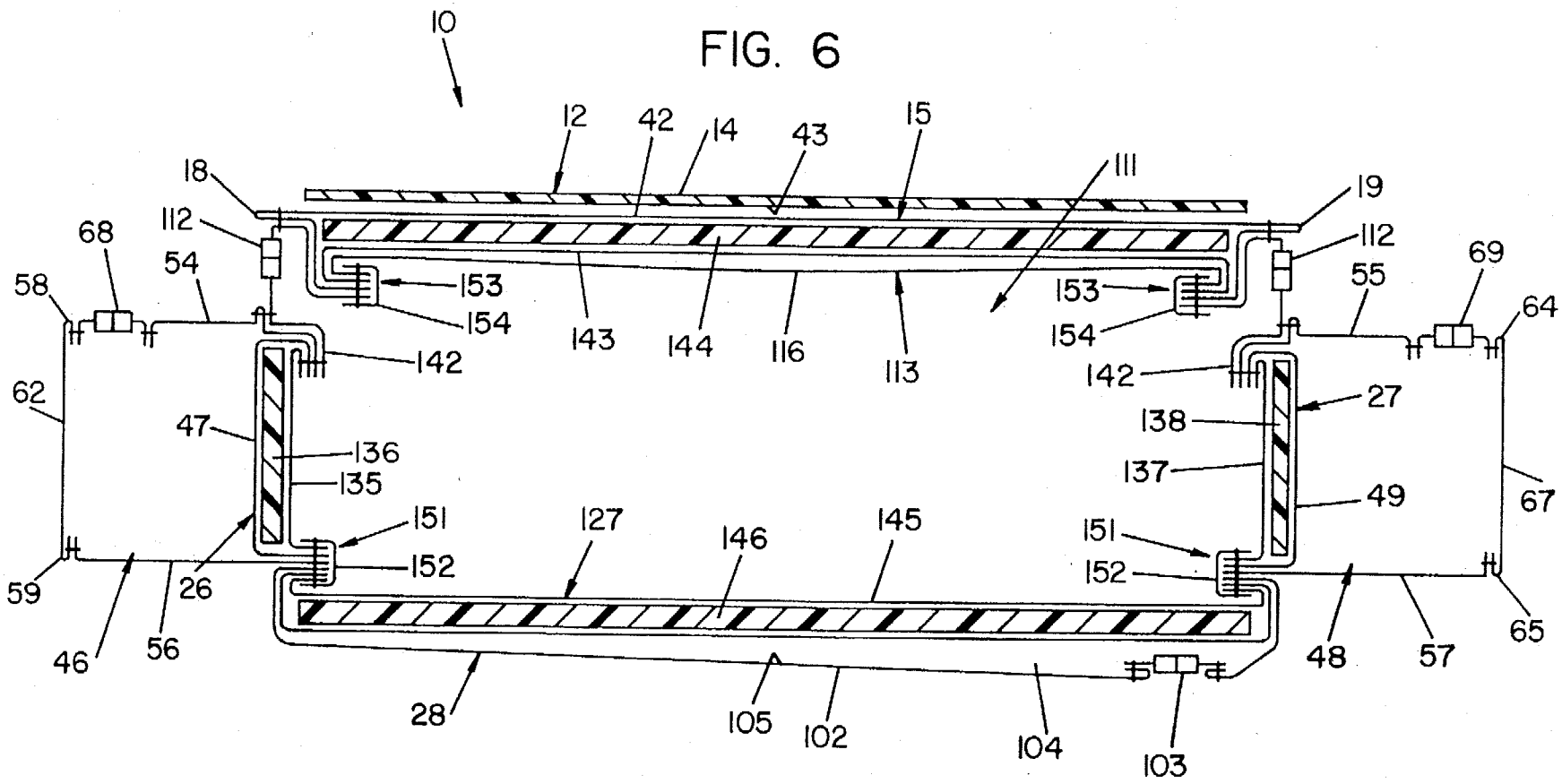
FIG. 6 is a cross-sectional view taken along line 6—6 of FIG. 5.

Referring now to FIGS. 5 and 6, each of top wall 24, bottom wall 25, right side wall 26 and left side wall 27 are lined, preferably with nylon, in the interior of main compartment 111. Further, each of walls 24–27 includes 5 mm thick foam, preferably EPE foam sandwiched between the outer surfaces of walls 24–27 and the inner lining. EPE foam is copolymer of tetrafluoroethylene, hexafluoropropylene and perfluoroalkyl vinyl ether. Specifically, the top inner lining 131 encloses a top foam panel 132 and a bottom inner lining 133 encloses a bottom foam panel 134. Further, a right side inner lining 135 encloses a right side foam panel 136 while a left side inner lining 137 encloses a left side foam panel 138. Foam panels 132, 134, 136 and 138 are enclosed by the stitched seams 142 adjacent front side wall 15. As can be seen, stitched seams 142 located at right and left side inner linings 135, 137 include top panels 54 and 55 of right and left side storage bins 46, 48, respectively.

Front side wall 15 includes a front side inner lining 143 enclosing front side foam panel 144, preferably 5 mm thick EPE foam. In contrast, a rear side inner lining 145 encloses rear side foam panel 146. Preferably, rear side foam panel 146 is constructed from 8 mm thick sponge foam to provide additional padding and comfort when rear side wall 28 is resting upon the lap of a child. The foam panels provided with 5 mm thick EPE foam provides flexible properties to each of walls 24–27 and front side wall 15 providing enough structural stability to front side wall 15 and walls 24–27 such that activity station 10 retains a boxlike shape even when empty. This is advantageous so that a child desiring to use activity station 10 as a work or writing surface has a firm surface on which to work.

Activity station 10 uses three types of welt seams. A welt seam 151 is used to retain foam panels 132, 134, 136 and 138 within each of walls 24, 25, 26 and 27 respectively, adjacent rear side wall 28. Welt seams 151 include a welt 152 which overlaps seam 151, and is stitched thereto, for added reinforcement. Welt seams 151, located adjacent right and left side walls 26, 27 also bind back panels 56, 57 of storage bins 46, 48 respectively and side pouch 104 on rear side wall 28. Welt seams 151 adjacent top wall 24 and bottom wall 25 also retain shoulder straps 81, 82. The welt seams 153 are located adjacent main compartment zipper 112 and within main compartment 111 and adjacent bottom wall 25, right side wall 26 and left side wall 27. Welt seams 153 include welts 154, stitched thereto, for extra reinforcement. Each of welt seams 153 work to enclose each of foam panels 134, 136 and 138 as well as front side foam panel 144 within bottom wall 25, right side wall 26, left side wall 27 and front side wall 15. A welt seam 155 is located adjacent top wall 24 and includes welt 156. Welt seam 155, in addition to working to enclose top foam panel 132 and front side foam panel 144 also retains portions of lateral pouch 114 and slide pouch 116. Importantly, welt seam 155 acts as a hinge for accessing main compartment 111. When main compartment zipper 112 is opened, as shown in FIG. 2, front side wall 15 rotates about axis A, to access main compartment 111.

Figure 7:
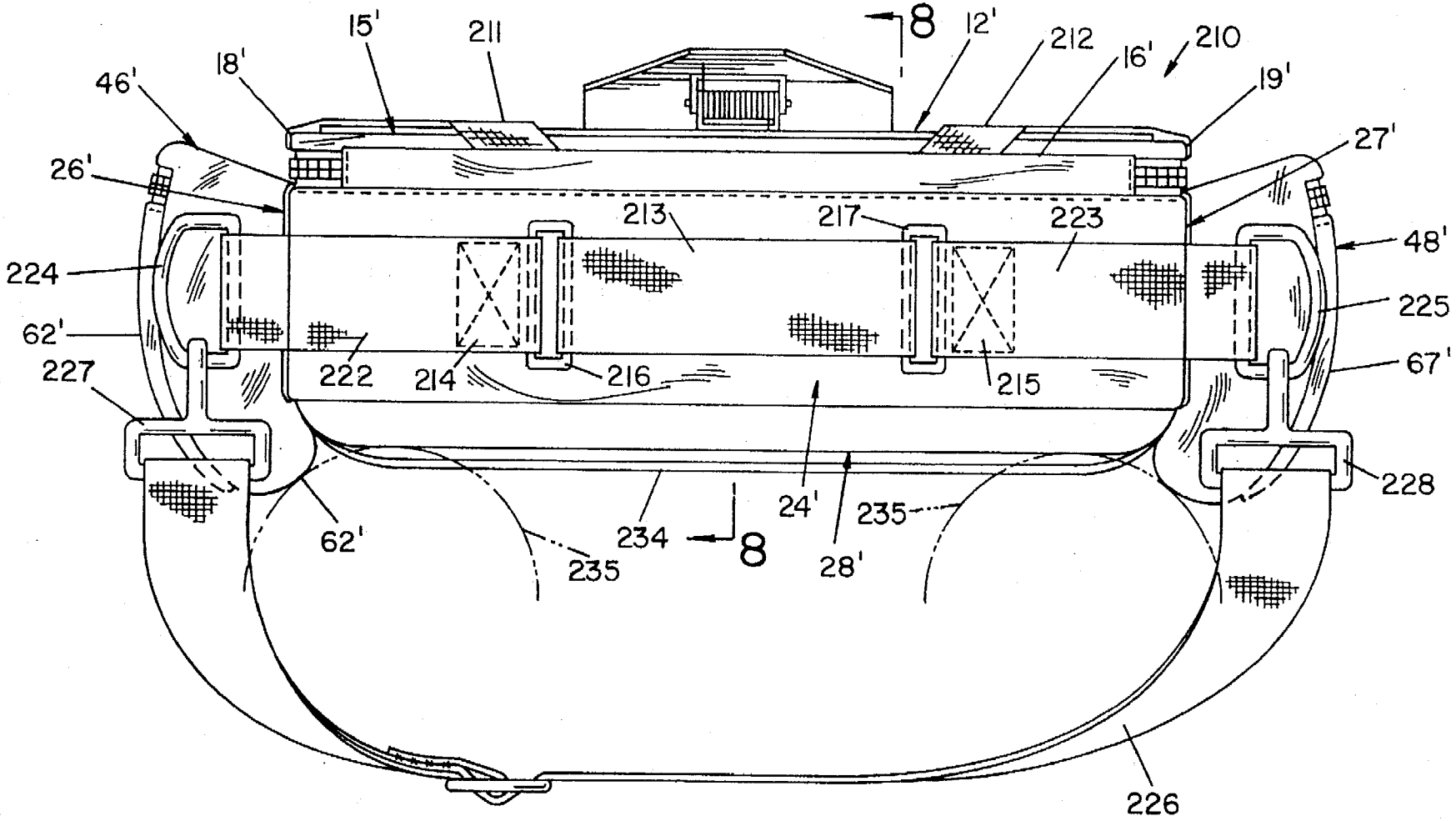
FIG. 7 is an elevation view showing an edge of an alternative embodiment from that shown in FIG. 4.; an FIG. 8 is a cross-sectional view taken along line 8—8 of FIG. 7.
Figure 8:
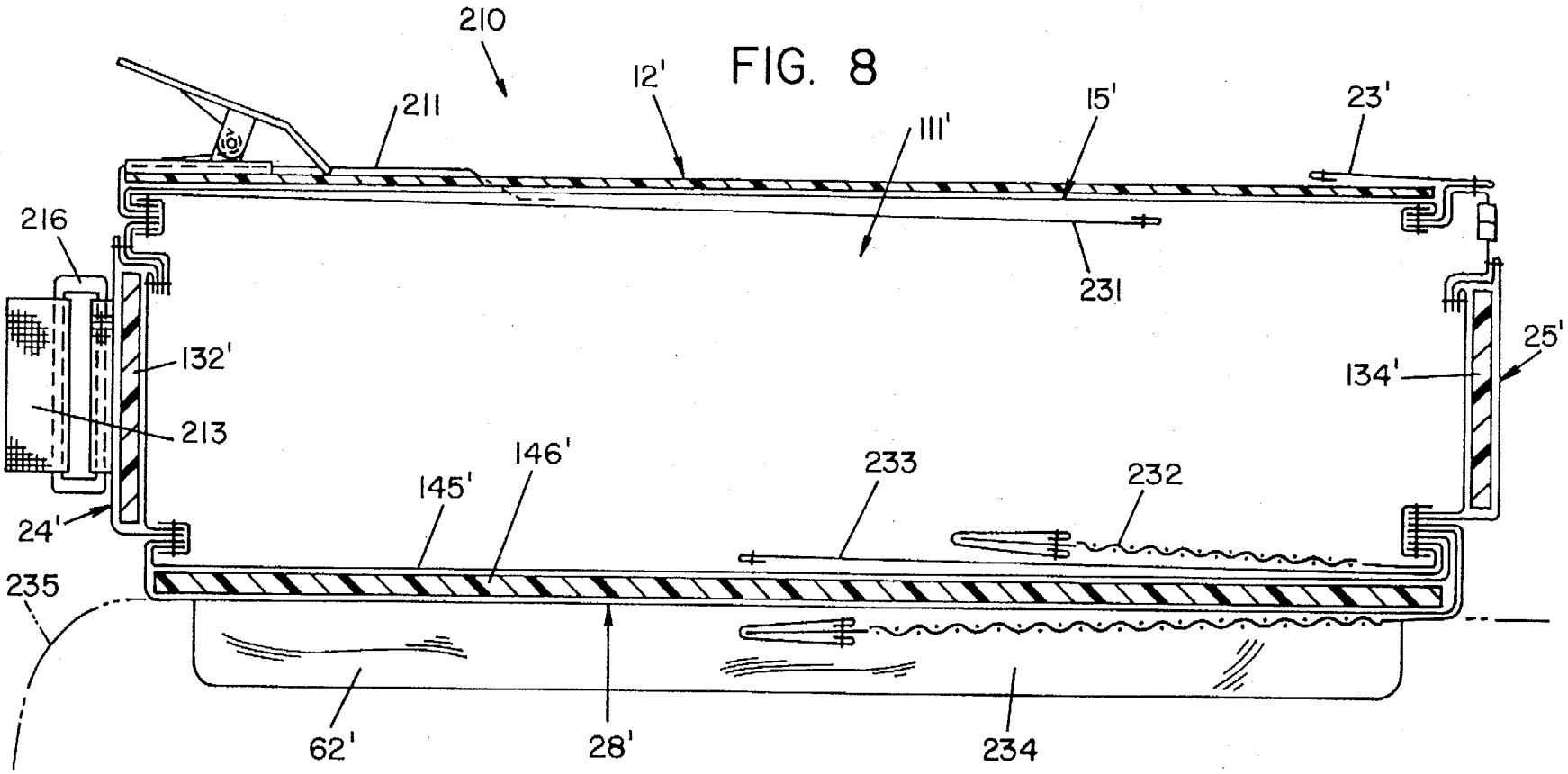

Referring now to FIGS. 7 and 8 where another embodiment of an activity station of the present invention is shown, activity station 210 retains many of the original features set forth in the specification above. Where those features are common, identical numbers denoted with a prime symbol, are provided. The embodiment of FIG. 7 also includes the gussets 211 and 212 which extend between a top edge 16' and a right side edge 18' for gusset 211 and between top edge 16' and a left side edge 19' for gusset 212. A front mesh pocket 23' is maintained. In contrast with the embodiment shown in FIGS. 1–6, hook and loop fasteners 32, 33 are eliminated. Thus, rigid panel 12' is retained on the front side wall 15'. It will be appreciated that like the embodiment in FIGS. 1–6, top wall 24', bottom wall 25', right side wall 26' and left side wall 27' include 5 mm thick EPE foam panels. The foam panels 132', 134', 136' and 138', while providing flexible wall surfaces provide sufficient structural rigidity such that rigid panel 12' is supported by walls 24', 25', 26' and 27'.

A carrying handle 213, preferably made from cotton webbing, is provided and attached to the box-stitched patch portions 214, 215 by the buckles 216, 217. A webbed portion 222 extends toward right side wall 26' while an identical webbed portion 223 extends toward left side wall 27'. The strap buckles 224 and 225 are stitched to the ends of web portions 222 and 223, respectively. An adjustable strap 226 including the strap clips 227 and 228 are attached to strap buckles 224 and 225, respectively. Thus, activity station 210 is convenient to carry on one shoulder instead of as a back pack as shown in FIGS. 1–6.

As best shown in FIG. 8, no foam panel or separate interior lining is used on front side wall 15'. Since rigid panel 12' is not easily removable, panel 12' retains front side wall 15' rigid at all times.

The main compartment 111' is provided with a pouch 231 and slide pockets 232 and 233. A rear side wall 28' is provided with a rear side foam panel 146' enclosed by a rear side inner lining 145'. Additionally, rear side wall 28' is provided with a sponge foam padding 234. This added padding provides greater comfort for use of activity station 210 over extended periods of time. The right side storage bin 46' and left side storage bin 48' have been altered in shape from the embodiment shown in FIGS. 1–6. Back panels 56, 57 have been eliminated in order that the outside panels 62' and 67' extend to rear side wall 28'. Thus storage bins 46' and 48' curve inwardly towards sponge foam padding 234. Bins 46' and 48' may be additionally stuffed with foam padding in order to provide outer lateral support to the knees 235 of a child, as shown in phantom in FIG. 7.

The invention has been described with reference to preferred embodiments. Obviously, modifications and alterations will occur to others upon reading and understanding this specification. For example, certain of the interior pockets and pouches may be eliminated and others added. Additionally, zippered pouches may be replaced with VELCRO pouches or other suitable fasteners. It is intended to include all such modifications and alterations in so far as they come within the scope of the invention.

Having thus described the invention, it is claimed:

1. A child's portable activity desk comprising a generally box shaped main compartment defined by a front wall, a rear wall, a top wall, a bottom wall, a first side wall and a second side wall; said front wall being substantially rigid, flat and having a first thickness, said rear wall being generally flexible, padded and having a second thickness generally greater than said first thickness of said front wall, said top wall being flexible and having a handle, said first side wall being flexible and said second side wall being flexible, a zipper in said first side wall, said bottom wall and said second side wall near said front wall whereby said main compartment may be opened with said front wall rotating about an axis near said top wall, said rear wall being provided with two straps fixed adjacent to said rear wall at both ends and adapted to fit around a child's arms whereby said desk may be carried on a child's back.

2. The desk of claim 1, wherein said top wall is provided with a ring near said first side wall and said top wall is provided with a ring near said second side wall whereby a shoulder strap may be connected to said desk.

3. The desk of claim 1, wherein said main compartment is provided with a plurality of pockets and pouches adapted to hold pencils, crayons, or markers.

4. The desk of claim 1, further comprising a storage bag for said main compartment, said storage bag being attached to said rear wall and removable therefrom, said storage bag being provided with hook fasteners adapted to engage loop fasteners attached to the interior of said rear wall.

5. A child's portable activity station comprising:

a generally rectangular front wall having a first thickness, a hard writing surface, a top edge, a bottom edge, a right side edge and a left side edge;

a generally flexible top wall having a handle attached thereto;

a generally flexible bottom wall attached to said bottom edge;

a generally flexible right side wall attached to said right side edge;

a generally flexible left side wall attached to said left side edge;

a generally flexible, padded rear wall attached to said top wall, said bottom wall, said right side wall and said left side wall, said rear wall having a second thickness, said second thickness being in the range between 1.5 and 2 times greater than said first thickness;

a generally box shaped main compartment enclosed by said rear wall, top wall, bottom wall, right side wall, left side wall and said front wall;

a zipper adapted to separate said front wall from the major portions of said bottom wall, said right side wall and said left side wall when said zipper is opened; and means for attaching said hard writing surface to said front wall including a pocket extending across said front wall between said right side edge and said left side edge, generally the length of said bottom edge, and further extending from said bottom edge toward said top edge, said pocket having a slotted opening extending between said right and left side edges for receiving said hard writing surface, said hard writing surface being detachable from said front wall.

6. The activity station of claim 5, including means for attaching said hard writing surface to said front wall, said attaching means includes interengaging hook and loop fasteners, said hook fasteners attached to said hard writing surface.

7. Activity station of claim 5, further comprising a plurality of front opening storage bins adjacent said hard writing surface.

8. A portable lap desk comprising:

a front side wall;

a rear side wall;

edge wall means extending between said front side wall and said rear side wall for defining a main compartment therebetween, said edge wall means including at least a first edge wall and a second edge wall, said front side wall intersecting said first edge wall at a first edge and intersecting said second edge wall at a second edge;

means for separating said front side wall from said first edge wall;

an axis adjacent to said second edge, said front side wall capable of rotating about said axis upon separating said front side wall from said first edge wall to open said main compartment;

handle means for transporting said lap desk, said handle means attached to said second edge wall; and said rear side wall being provided with two straps extending thereacross, each of said two straps fixed adjacent to said rear side wall at a first end and at a second end of each of said two straps, said two straps adapted to fit around a child's arms for carrying said desk on a child's back.

9. The lap desk of claim 8, wherein said means for separating includes a zipper.

10. The lap desk of claim 9, wherein said zipper is located in said first edge wall.

11. The lap desk of claim 10, wherein said zipper is located adjacent said first edge and parallel to said front side wall.

12. The lap desk of claim 8, wherein said means for separating is located in said first edge wall.

13. The lap desk of claim 8, wherein said means for separating is located adjacent said first edge and parallel to said front side wall.

14. The lap desk of claim 13, wherein said means for separating includes a zipper.

15. The lap desk of claim 8, wherein said second edge wall is a generally planar surface.

16. The lap desk of claim 15, wherein said axis is parallel to said second edge wall.

17. The lap desk of claim 16, wherein said means for separating includes a zipper.

18. A portable lap desk comprising a front side wall, a rear side wall and edge wall means extending therebetween for defining a main compartment, said front side wall being planar and substantially rigid and having a first thickness, said rear side wall being flexible, including a padded area and having a second thickness greater than said first thickness of said front side wall, said front side wall including a rigid panel having a writing surface thereon, said rigid panel removable from said front side wall, said front side wall including at least one slotted opening for retaining said rigid panel thereon, said at least one slotted opening including at least one pocket on said front side wall and having four edges, three of said four edges attached to said front side wall, said rigid panel including at least one edge portion retained within said at least one pocket, said front side wall and said rigid panel further including mutually engaging hook and loop fastener means for retaining said rigid panel on said front side wall.

19. The lap desk of claim 18, wherein said edge wall means includes an attached carrying handle.

20. The lap desk of claim 18, wherein said edge wall means includes at least a first edge wall and a second edge wall and means for separating said front side wall from said first edge wall.

21. The lap desk of claim 20, wherein said first edge wall includes a first side wall portion extending from said second edge wall, a second side wall portion extending from said second edge wall and a bottom wall portion extending between said first side wall portion and said second side wall portion, each of said first side wall portion and said second side wall portion having a side storage bin attached thereto, said side storage bins having an access opening and a zipper for opening and closing said access opening.

22. The lap desk of claim 21, wherein said first side wall portion is generally parallel to said second side wall portion.

23. The lap desk of claim 22, wherein said bottom wall portion is generally perpendicular to said first and said second side wall portions and said bottom wall portion is generally parallel to said second edge wall.

24. The lap desk of claim 23, wherein said second edge wall includes an attached carrying handle.

25. The lap desk of claim 18, wherein said rigid panel includes a clip fixedly attached thereon.

26. The lap desk of claim 18, wherein said rear side wall includes a slotted opening therein.

27. The lap desk of claim 18, wherein said main compartment includes a storage bag therein, said bag removably attached in said main compartment.

28. The lap desk of claim 27, wherein each of said storage bag and an interior surface of said main compartment includes mutually engaging hook and loop fastener means for attaching said storage bag in said main compartment.

29. The lap desk of claim 18, further including at least one storage bin attached to said edge wall means and capable of being accessed independently of said main compartment.

30. The lap desk of claim 18, wherein said edge wall means is flexible.

31. The lap desk of claim 30, wherein said edge wall means includes a foam core whereby said edge wall means is self-supporting.

32. The lap desk of claim 18, wherein said edge wall means includes flexible self supporting means for retaining a planar shape to said edge wall means.

* * * * *